US010595566B2

(12) United States Patent
Jiang et al.

(10) Patent No.: US 10,595,566 B2
(45) Date of Patent: Mar. 24, 2020

(54) CARTRIDGE AND ELECTRONIC CIGARETTE HAVING SAME

(71) Applicant: Shenzhen First Union Technology Co., Ltd., Shenzhen, Guangdong Province (CN)

(72) Inventors: Pengfei Jiang, Shenzhen (CN); Yonghai Li, Shenzhen (CN); Zhongli Xu, Shenzhen (CN)

(73) Assignee: Shenzhen First Union Technology Co., Ltd. (CN)

( * ) Notice: Subject to any disclaimer, the term of this patent is extended or adjusted under 35 U.S.C. 154(b) by 188 days.

(21) Appl. No.: 15/859,442

(22) Filed: Dec. 30, 2017

(65) Prior Publication Data

US 2018/0184717 A1 Jul. 5, 2018

(30) Foreign Application Priority Data

Dec. 30, 2016 (CN) ..... 2016 2 1479758 U

(51) Int. Cl.
*A24F 13/00* (2006.01)
*A24F 47/00* (2020.01)
*H05B 3/44* (2006.01)

(52) U.S. Cl.
CPC ..... *A24F 47/008* (2013.01); *H05B 3/44* (2013.01)

(58) Field of Classification Search
CPC ..... A24F 47/00
USPC ..... 131/328–329
See application file for complete search history.

(56) References Cited

U.S. PATENT DOCUMENTS 10,136,675 B2 * 11/2018 Li ..... A24F 47/008
2015/0181943 A1 * 7/2015 Li ..... H05B 3/48 131/329
2015/0335073 A1 11/2015 Li et al.
2016/0192710 A1 7/2016 Liu

FOREIGN PATENT DOCUMENTS

CN 205 456 063 U 8/2016
EP 3 020 292 A1 5/2016
EP 2 965 642 A1 7/2016

* cited by examiner

*Primary Examiner* — Phuong K Dinh
(74) *Attorney, Agent, or Firm* — PROI Intellectual Property US

(57) ABSTRACT

A cartridge comprises an outer sleeve tube, an air passage tube located in the outer sleeve tube, and an atomization device. An annular space between the outer sleeve tube and the air passage tube forms a liquid storage chamber configured for storing tobacco liquid. The liquid storage chamber has an annular opening, which is blocked with a porous liquid conducting body. The porous liquid conducting body has a first surface and an opposite second surface, and is configured for conveying the tobacco liquid from the first surface to the second surface and supplying the tobacco liquid to the atomization device, the first surface being in contact with the tobacco liquid in the liquid storage chamber and the second surface being in contact with the atomization device. The atomization device is configured for aerosolizing the tobacco liquid to generate an aerosol to be expelled into the air passage tube.

8 Claims, 4 Drawing Sheets

CARTRIDGE AND ELECTRONIC CIGARETTE HAVING SAME

CROSS REFERENCE TO RELATED APPLICATIONS

The present application claims priority to Chinese Patent Application CN201621479758.9 filed on Dec. 30, 2016.

TECHNICAL FIELD

The present disclosure relates to the field of smoking sets, and particularly, to an atomization cartridge and an electronic cigarette having the same atomization cartridge.

BACKGROUND

At present, a typical cigarette cartridge used for an electronic cigarette includes a sleeve tube and an atomization device located in the sleeve tube. The atomization device is composed of a liquid guide plate, a liquid storage layer, a liquid guide string, a heating wire disposed on the liquid guide string, and other parts. These parts compose a module which completes functions such as liquid guide, liquid storage and atomization. However, the module has one layer restricted by another layer, has many parts and is complex in structure, consequently the installation is tedious, the production unification is difficult to control, the finished product has poor stability, and the product cost is very high. In the structure of the above atomization device, tobacco liquid first enters the liquid storage layer from the liquid guide plate, and then is absorbed to the heating wire from the liquid storage layer by the liquid guide string. The liquid guide and liquid storage efficiencies are very low; and peculiar smells caused by insufficient liquid guided are easy to appear, such as burnt smell. As a result, consumers probably may have an antipathy when experiencing healthy vapor.

SUMMARY

The technical problem to be solved by the present disclosure is to remedy the drawbacks of the prior art by providing an atomization cartridge and an electronic cigarette that are simple in structure and have high liquid guide efficiency.

In order to solve the above technical problem, the present disclosure provides an atomization cartridge. The atomization cartridge includes an outer sleeve tube, an air passage tube located in the outer sleeve tube, and an atomization device located in the outer sleeve tube. An annular space is defined between the outer sleeve tube and the air passage tube, forming a liquid storage chamber configured for storing tobacco liquid. The liquid storage chamber has an annular opening. The annular opening is blocked with a porous liquid conducting body. The porous liquid conducting body has a first surface and an opposite second surface. The first surface is in contact with the tobacco liquid in the liquid storage chamber, and the second surface is in contact with the atomization device. The porous liquid conducting body is configured for conveying the tobacco liquid from the first surface to the second surface and supplying the tobacco liquid to the atomization device, and the atomization device is configured for aerosolizing the tobacco liquid to generate an aerosol to be expelled into the air passage tube.

Preferably, the atomization device is a heating sheet or heating net attached on the second surface.

Further, the heating sheet or heating net includes a heating portion located in the middle thereof and an electrical contact portion located at two sides of the heating portion.

Further, the second surface has disposed thereon a plurality of locating columns configured for fixing the heating sheet or heating net.

Further, below the heating sheet or heating net is further disposed a fixing sleeve configured for pressing against the heating sheet or heating net, the fixing sleeve is assembled on an inner wall of the outer sleeve tube, and in the fixing sleeve is further disposed a snap fit portion configured for making a connection to a power supply module.

Further, a top center of the porous liquid conducting body defines a cavity portion configured for insertion of the air passage tube, and the top of the porous liquid conducting body forms the first surface through an annular surface formed by the cavity portion.

Further, the second surface defines at least one airflow hole in communication with the cavity portion.

Further, an elastic liquid-sealing ring is further disposed between the air passage tube and the porous liquid conducting body.

Preferably, the porous liquid conducting body is a fiber cotton block, a microporous ceramic body or foamed metal molded by sintering.

The present disclosure provides an electronic cigarette. The electronic cigarette includes an atomization cartridge and a power supply module. The power supply module is connected to the atomization cartridge and is configured for supplying power to the atomization device. The atomization cartridge can be selected from the atomization cartridges involved in the above preferred schemes.

The beneficial effects of the present disclosure are mainly as follows. The atomization cartridge involved in the present disclosure replaces the combination of the liquid storage layer, the liquid guide string and other parts involved in the prior art by the porous liquid conducting body, and the atomization device is attached directly on the second surface of the porous liquid conducting body; therefore, functions such as liquid guide and liquid storage can be well synthesized; the atomization cartridge employs single-piece assembly, the structure is simple and the products are uniform and have high reliability. Since the interior of the porous liquid conducting body is a microporous structure, good liquid guide effect can be achieved; meanwhile, due to the surface tension of the tobacco liquid, the tobacco liquid can be well stored in the microporous material. When the atomization device heats up, the molecule flowing of the tobacco liquid accelerates, so that the supplied tobacco liquid is sufficient and peculiar smells caused by insufficient tobacco liquid are avoided.

DETAILED DESCRIPTION

The structure and operating principle of the above atomization cartridge and electronic cigarette are illustrated below in further detail using exemplary embodiments.

Figure 1:
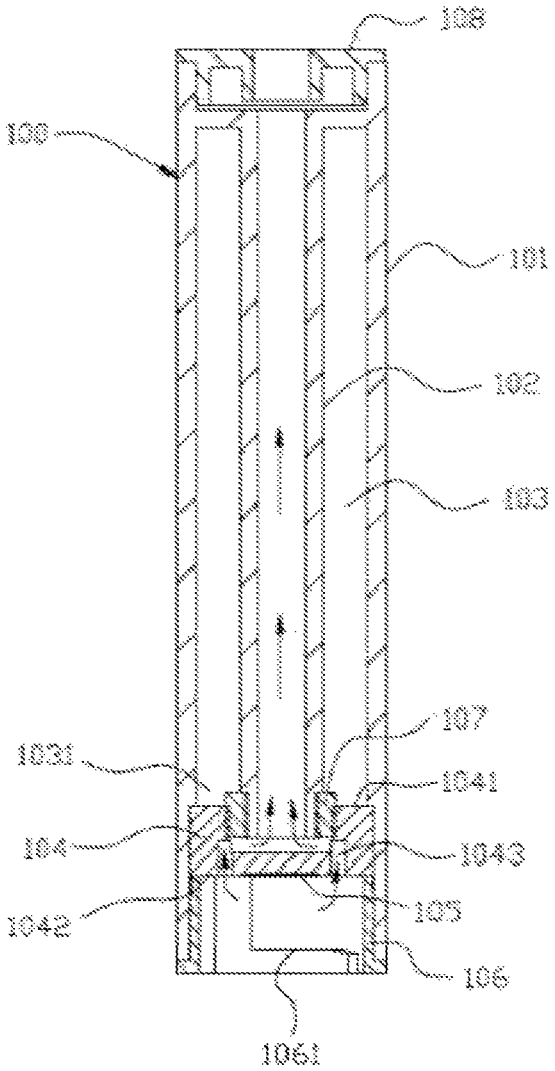
FIG. 1 is an axial cross-sectional view of an atomization cartridge provided by an embodiment.
Figure 2:
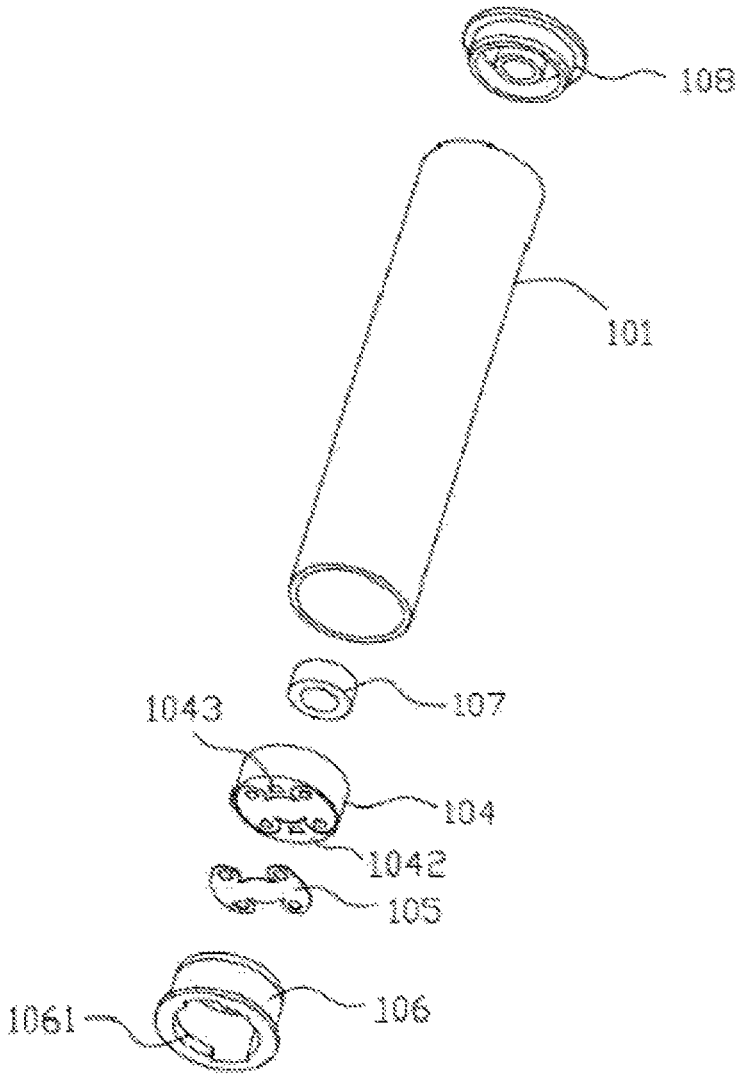
FIG. 2 is an exploded view of an atomization cartridge according to an embodiment.

Referring to FIG. 1 and FIG. 2, this embodiment provides an atomization cartridge 100. The atomization cartridge 100 includes an outer sleeve tube 101, an air passage tube 102 located in the outer sleeve tube 101, an atomization device located in the outer sleeve tube 101, and a porous liquid conducting body 104 located in the outer sleeve tube 101. An annular space between the outer sleeve tube 101 and the air passage tube 102 defines a liquid storage chamber 103 configured for storing tobacco liquid. The liquid storage chamber 103 has an annular opening 1031. Another end of the liquid storage chamber 103 opposite the annular opening 1031 is an enclosed structure. In this embodiment, the outer sleeve tube 101 and the air passage tube 102 are integrally molded. Tobacco liquid can be filled into the liquid storage chamber 103 when the porous liquid conducting body 104 is not plugged into the annular opening 1031. Another end of the outer sleeve tube 101 opposite the porous liquid conducting body 104 has a mouthpiece 108 disposed thereon. The mouthpiece 108 is in communication with the air passage tube 102, serving as an air outlet for vapor.

The porous liquid conducting body 104 is plugged into the annular opening 1031. The porous liquid conducting body 104 has a first surface 1041 and a second surface 1042 disposed opposite each other. The first surface 1041 is in contact with the tobacco liquid in the liquid storage chamber 103, and the second surface 1042 is in contact with the atomization device. The porous liquid conducting body 104 is configured for conveying the tobacco liquid from the first surface 1041 to the second surface 1042 and supplying the tobacco liquid to the atomization device, and the atomization device is configured for aerosolizing the tobacco liquid to generate an aerosol to be expelled into the air passage tube 102.

As a preferred implementation of this embodiment, the atomization device is a heating sheet or heating net attached on the second surface 1042. This embodiment is described by taking a heating sheet 105 having a specific structure for example. The porous liquid conducting body 104 preferably adopts materials having capillary action, such as fiber cotton block, microporous ceramic body or foamed metal molded by sintering, and polymer porous material. The porous liquid conducting body 104 can guide slowly the tobacco liquid from the first surface 1041 to the second surface 1042 by capillary action. The heating sheet 105 is attached on the second surface 1042 directly, which can also accelerate the flowing of the tobacco liquid, improve the supply amount of the tobacco liquid and guarantee the atomization efficiency. Due to the surface tension effect of the porous liquid conducting body 104, the interior of the porous liquid conducting body 104 can store certain amount of tobacco liquid, thereby achieving a liquid storage effect.

Figure 3:
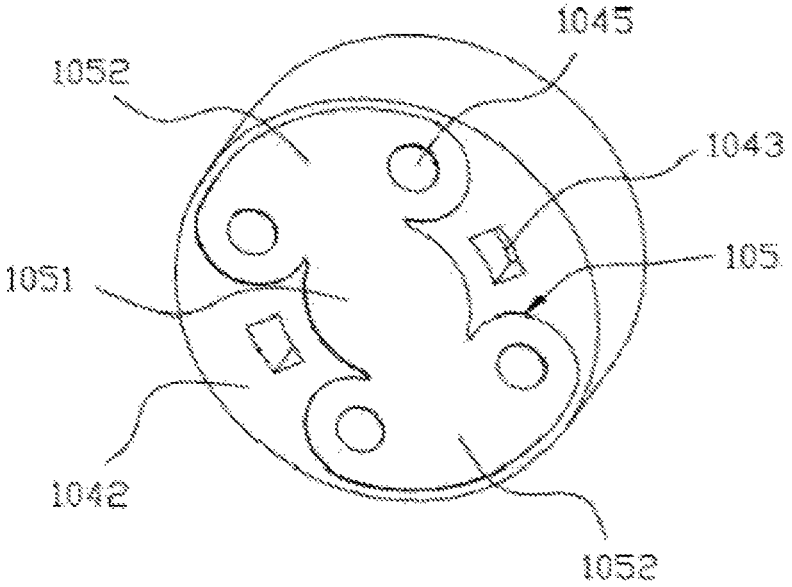
FIG. 3 is a bottom view of a porous liquid conducting body according to an embodiment.

Referring to FIG. 3, the heating sheet 105 (or heating net) includes a heating portion 1051 located in the middle thereof and an electrical contact portion 1052 located at two sides of the heating portion 1051. The heating portion 1051 and the electrical contact portion 1052 can be integrally molded. The electrical contact portion 1052 has a width greater than that of the heating portion 1051, so as to be in good contact with a power supply module.

In order to realize connection to the power supply module, below the heating sheet 105 is further disposed a fixing sleeve 106 configured for pressing against the heating sheet 105; the fixing sleeve is assembled on an inner wall of the outer sleeve tube 101; and in the fixing sleeve 106 is further disposed a snap fit portion 1061 configured for making a connection to the power supply module. When in assembly, the porous liquid conducting body 104 and the heating sheet 105 are first assembled into one and then are assembled into the annular opening 1031, and finally the fixing sleeve 106 is assembled into the outer sleeve tube 101 to press the heating sheet 105 against the second surface 1042. The structure is simple and the assembly is easy. When the power supply module makes a snap fit connection to the snap fit portion 1061, an electrode on the power supply module can be in contact with the electrical contact portion 1052 respectively.

As a preferred implementation of this embodiment, the second surface 1042 has disposed thereon a plurality of locating columns 1045 configured for fixing the heating sheet 105 or heating net. When the heating sheet 105 is in rotating connection with the power supply module, the locating columns 1045 can prevent the power supply module driving the heating sheet 105 to move.

Figure 4:
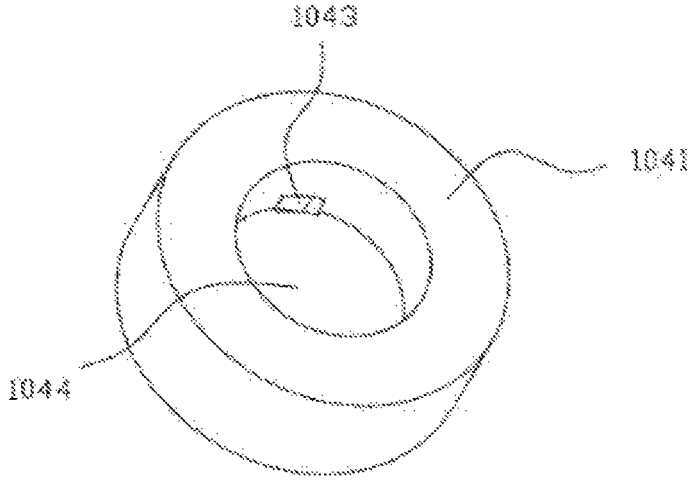
FIG. 4 is a top view of a porous liquid conducting body according to an embodiment.

Referring to FIG. 4, a top center of the porous liquid conducting body 104 defines a cavity portion 1044 configured for insertion of the air passage tube 102, and the top of the porous liquid conducting body 104 forms the first surface 1041 through an annular surface formed by the cavity portion 1044.

As a preferred implementation of this embodiment, the second surface 1042 defines at least one airflow hole 1043 in communication with the cavity portion 1044. In this embodiment, the number of the airflow hole 1043 is two, which are distributed at two sides of the heating sheet 105 symmetrically. The airflow hole 1043 runs through the porous liquid conducting body 104. The heating sheet 105 heats the tobacco liquid on the second surface 1042 to generate an aerosol, which can flow upwards to the cavity portion 1044 and the air passage tube 102 through the airflow hole 1043 along with an air flow. Moreover, the airflow hole 1043 is not located at the center of the cavity portion 1044, but at the side edge of the cavity portion 1044. When the aerosol in the air passage tube 102 condenses to form liquid drops, the liquid drops can flow back downwards and fall onto a bottom surface of the cavity portion 1044 to be absorbed again by the porous liquid conducting body 104 and aerosolized again. In addition, as a preferred measure, an elastic liquid-sealing ring 107 is further disposed between the air passage tube 102 and the porous liquid conducting body 104. The elastic liquid-sealing ring 107 adopts a silicone ring preferably, and is disposed between the air passage tube 102 and a side wall of the cavity portion 1044 to prevent the leakage of the tobacco liquid in the liquid storage chamber 102.

Figure 5:
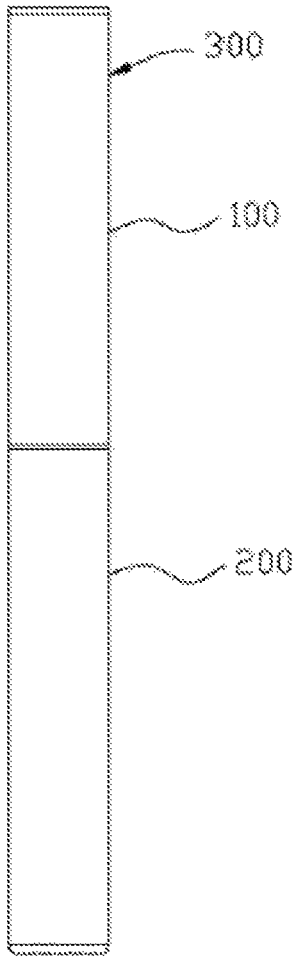
FIG. 5 is a diagram of an electronic cigarette provided by an embodiment.

Referring to FIG. 5, this embodiment further provides an electronic cigarette 300. The electronic cigarette 300 includes an atomization cartridge 100 and a power supply module 200. The structure of the atomization cartridge is as described above, and repeated description is omitted here. The power supply module 200 is in detachable connection with the atomization cartridge 100 and makes an electrical connection to the above heating sheet 105 (atomization device) to supply power to the heating sheet 105.

The above embodiments are merely partial implementations listed in the description to help understand the content of the present disclosure, and they neither restrict the technical scheme of the present disclosure, nor make an exhaustion of all schemes implementable. Any minor improvements or equivalent substitutions made to the structures, processes or steps of the present disclosure are intended to be included in the scope of protection of the present disclosure.

What is claimed is:

1. A cartridge, comprising an outer sleeve tube, an air passage tube located in the outer sleeve tube, and an atomization device located in the outer sleeve tube, an annular space defined between the outer sleeve tube and the air passage tube forming a liquid storage chamber configured for storing tobacco liquid, the liquid storage chamber having an annular opening, wherein the annular opening is blocked with a porous liquid conducting body, the porous liquid conducting body has a first surface and an opposite second surface, the first surface is in contact with the tobacco liquid in the liquid storage chamber, the second surface is in contact with the atomization device, the porous liquid conducting body is configured for conveying the tobacco liquid from the first surface to the second surface and supplying the tobacco liquid to the atomization device, and the atomization device is configured for aerosolizing the tobacco liquid to generate an aerosol to be expelled into the air passage tube, wherein the atomization device is a heating sheet or heating net attached on the second surface, wherein the second surface has disposed thereon a plurality of locating columns configured for fixing the heating sheet or heating net.

2. The cartridge according to claim 1, wherein the heating sheet or heating net comprises a heating portion located in the middle thereof and an electrical contact portion located at two sides of the heating portion.

3. The cartridge according to claim 1, wherein below the heating sheet or heating net is further disposed a fixing sleeve configured for pressing against the heating sheet or heating net, the fixing sleeve is assembled on an inner wall of the outer sleeve tube, and in the fixing sleeve is further disposed a snap fit portion configured for connecting to a power supply module.

4. The cartridge according to claim 1, wherein a top center of the porous liquid conducting body defines a cavity portion configured for insertion of the air passage tube, and the top of the porous liquid conducting body forms the first surface through an annular surface formed by the cavity portion.

5. The cartridge according to claim 4, wherein the second surface defines at least one airflow hole in communication with the cavity portion.

6. The cartridge according to claim 4, wherein an elastic liquid-sealing ring is further disposed between the air passage tube and the porous liquid conducting body.

7. The cartridge according to claim 1, wherein the porous liquid conducting body is a fiber cotton block, a microporous ceramic body or foamed metal molded by sintering.

8. An electronic cigarette, comprising a cartridge and a power supply module, wherein the cartridge is the cartridge according to claim 1, and the power supply module is connected to the cartridge and is configured for supplying power to the atomization device.

* * * * *